US005690563A

United States Patent [19]

Gammon

[11] Patent Number: 5,690,563

[45] Date of Patent: Nov. 25, 1997

[54] BIODEGRADABLE GOLF TEE

[76] Inventor: Albert L. Gammon, 418 Mountain Creek Rd., Albermarle, N.C. 28001

[21] Appl. No.: 781,186

[22] Filed: Jan. 9, 1997

[51] Int. Cl.[6] ..... A63B 57/00

[52] U.S. Cl. ..... 473/399

[58] Field of Search ..... 473/387, 388, 473/389, 390, 391, 392, 393, 394, 395, 396, 397, 398, 399, 400, 401, 402, 403; 71/15, 16, 19, 20, 22

[56] References Cited

U.S. PATENT DOCUMENTS 4,126,438 11/1978 Pulli et al. ..... 473/399
4,909,508 3/1990 Noland et al. ..... 473/399
5,021,077 6/1991 Moore ..... 73/19
5,431,392 7/1995 Carson et al. ..... 473/399

*Primary Examiner*—Steven B. Wong
*Attorney, Agent, or Firm*—Dallis Law Firm, P.A.

[57] ABSTRACT

A biodegradable golf tee made from compressed rendered animal meal. The rendered animal meal comprises rendered animal by-products from processed meats and fish. After rendering the animal by-product and drying the material is ground to a fine powder or meal. The rendered animal meal is compressed at room temperature in the form of a golf tee. A corn starch adhesive is sprayed on the surface of the biodegradable golf tee to add strength and protect the biodegradable golf tee from humidity. The biodegradable golf tee will decompose after direct contact with water in the form of dew or rain.

7 Claims, 1 Drawing Sheet

BIODEGRADABLE GOLF TEE

BACKGROUND OF THE INVENTION

1. Field of the Invention

The present invention relates to the composition of a golf tee and, more particularly to a biodegradable golf tee composed of self-binding animal renderings resulting in a golf tee that is 100% biodegradable.

2. Description of the Related Art

The conventional golf tees are generally composed of wood or plastic material. After using a golf tee, they are often time left on the playing grounds and must be collected by golf course workers. There are various types of decomposable golf tee compositions which would result in a golf tee that would break down and integrate into the soil by weathering. The advantage of such a golf tee is clear; there would be no need to pick up the tee after use. The biodegradable golf tee could be manufactured at low cost, and the playing greens and fairways could be free from the unsightliness of broken golf tees on the box. Such a golf tee, however, must be both sufficiently rigorous so as to meet the requirements of a standard plastic or wood tee and but still be capable of thoroughly breaking down into the soil and grass without adversely effecting the greens and fairways.

Some examples of the prior art include U.S. Pat. No. 5,040,792 to Takigawa which relates to a decomposable golf tee composed of pulverized natural organic material and pulverized natural inorganic material. The contents of "pulverized natural organic" material in the Takigawa patent include vegetable matter such as starch, pearl barley, corn, wheat, rice and tofu-dregs. U.S. Pat. No. 5,046,730 to Golden also relates to a decomposable golf tee, but one composed of sugar, cellulosic fiber, water soluble polymer, and plasticizer. U.S. Pat. No. 5,082,264 to Takeno discloses a similar product composed of clay and a binder substance. U.S. Pat. No. 5,085,432 to Takeno relates to a method of manufacturing certain decomposable golf tees using pulverized granite, pulp, starch, and preservatives.

Although the identified prior art includes various types of golf tees made of decomposable materials, none are made of 100% rendered animal materials. The advantage of such a composition is that the material would be 100% biodegradable but would not interfere with the nutrient balance of the green. An additional advantage of making golf tees from animal renderings is that there is no need for adding foreign binding compounds, because the rendered animal meal releases natural oils that act as binders when compressed under the proper conditions. Often times, these animal materials are treated as a waste product under most food processing conditions making the biodegradable golf tee inexpensive to make.

SUMMARY OF THE INVENTION

It is therefore an objective of this invention to provide a biodegradable composition moldable to a form golf tee made from animal renderings.

It is further an objective of this invention to provide a mold material moldable at room temperature to form a golf tee.

It is yet further an objective of this invention to provide a disposable golf tee having sufficient physical durability.

It is still further an objective of this invention to be biodegradable and decompose in an environmentally sound fashion when left on the golf course or exposed to both humans and animals alike.

These as well as other objectives are accomplished by a biodegradable golf tee made of compressed rendered animal meal comprising the by-products of processed meat. The sources of such processed meat include cattle, pork, lamb, chicken and fish. The preferred embodiment of the rendered animal meal derived from these by-products contains varying portions of animal material from the categories of (1) bone and cartilage, (2) muscle and soft tissues (excluding organs) and (3) organs including skin.

The present invention provides environmentally safe composites of rendered by-products from the animal groups used in food processing. This invention will decompose within 48 hours once in contact with water. If this present invention is consumed by an animal which takes residence at the golf course no harm will come its way. If the biodegradable golf tee were to become lodged in the throat of the animal or digestive tract, the natural body fluids will degrade the golf tee before harming the animal. Present decomposable tees are not widely used today because of their organic/inorganic compounds. In the case of decomposable golf tees made with grass seeds, a typical golf course greens keeper would not want to introduce a potentially incompatable grass seed on the golf course in fear that the foreign grass would grow out of control. Similarly, a typical greens keeper would be against the use of golf tees made from fertilizer as they would potentially burn the fairway grass. The present invention, however, is very safe and friendly to the environment.

BRIEF DESCRIPTION OF THE DRAWINGS

A preferred embodiment of the present invention is described herein with reference to the drawings wherein.

DETAILED DESCRIPTION OF THE PREFERRED EMBODIMENT

Figure 1:
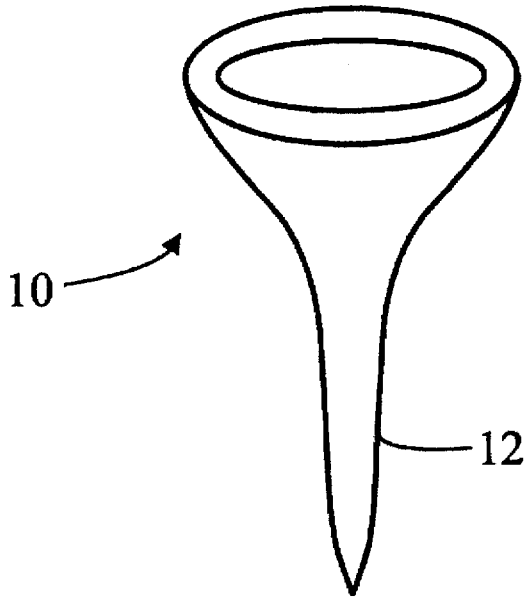
FIG. 1 of the drawings is a perspective view showing a shaft section which is sharply pointed at the bottom end for insertion into the ground and a bowl section appropriately shaped to receive a golf ball.
Figure 2:
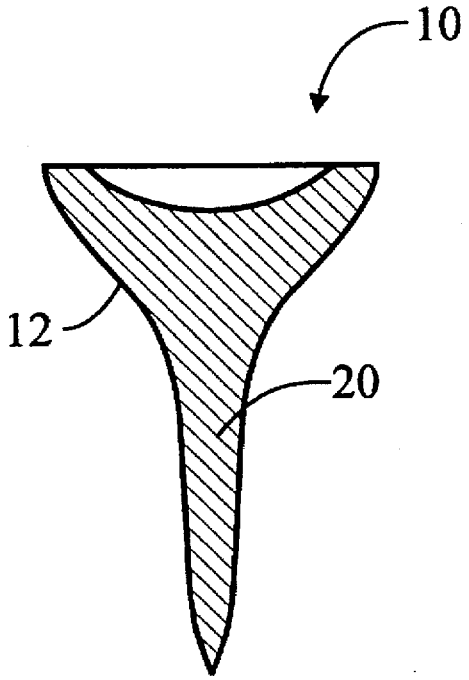
FIG. 2 of the drawings is a cross sectional view of the invention revealing the compressed rendered animal meal interior.

Referring to FIGS. 1 and 2 the biodegradable golf tee (10) is shown comprising an exterior corn starch adhesive (12) and the interior compressed rendered animal meal (20).

In order to achieve the above mentioned objectives according to the present invention, the biodegradable golf tee (10) is composed of 100% natural organic substances from rendered animal and/or fish by-products. The by-products are from anti-mortem to post-mortem processing of animal and fish. The typical contents of such by-product include bones, cartilage, soft tissue, muscle and organs.

Animal by-product can be found in numerous meat processing industries. The same type of animal by-product, whether pork, cattle, lamb or fish can be used as the raw material necessary to produce the biodegradable golf tee (10). In the case of fish by-product the ingredients would comprise skin, scales, bone, soft tissue and organs.

The by-product composition is comprised of an ideal range of the following animal parts, by volume:

(1) approximately seventy percent (70%) to ninety percent (90%) bone and cartilage;

(2) approximately ten percent (10%) to thirty percent (30%) muscle and soft tissues (excluding organs); and (3) approximately zero percent (0%) to ten percent (10%) organs, including skin.

These percentage ranges of animal parts also correspond to the expected portions of animal parts typically encountered as waste by-product from a meat processing plant.

The raw by-product is crushed and then placed into a cooker and cooked to approximately 180 degrees Fahrenheit to remove excess fats, tumbled dried and then ground to a very fine powder. The powder is then placed in a dry feed mold and pressed at between 1,700 and 1,900 lb/square inch to the shape of the biodegradable golf tee (10). No binders are needed as an adhesive, because the natural oils in the compressed rendered animal meal act as a binding compound. The preferred embodiment uses by-products from the scientific animal classifications of Bovidae, Suidae, Superclass Agnathia, Superclass Gnathostomdta and Phasianidae.

After the molded form is made through compression, a corn starch adhesive (12) is sprayed on the biodegradable golf tee (10) to add exterior strength and firmness in the biodegradable golf tee (10). The invention will not decompose with ambient humidity. The decomposing process starts when the biodegradable golf tee (10) comes in direct contact with water in the form of dew or rain and decomposes within approximately 36 to 48 hours.

A preferred embodiment of the present invention is described herein. It is to be understood, of course, that changes and modifications may be made in the embodiment without departing from the true scope and spirit of the present invention as defined by the appended claims.

That which is claimed is:

1. A biodegradable golf tee formed from a moldable composition compressible at room temperature and decomposable upon contact with water, said biodegradable golf tee comprising a rendered animal meal made from pulverized animal parts selected from the group of scientific animal classifications consisting of Bovidae, Suidae, Superclass Agnathia, Superclass Gnathostomdta and Phasianidae.

2. The biodegradable golf tee according to claim 1 wherein said rendered animal meal is derived from waste products from animal processing and comprises, prior to rendering, by volume:

a. seventy percent (70%) to ninety percent (90%) bone and cartilage;

b. ten percent (10%) to thirty percent (30%) muscle and soft tissues; and c. zero percent (0%) to ten percent (10%) organs.

3. The biodegradable golf tee according to claim 1 wherein said rendered animal meal is molded into the shape of a typical golf tee by applying a pressure onto said rendered animal meal into a dry feed mold, said pressure being at a range between 1,700 pounds per square inch and 1,900 pounds per square inch.

4. The biodegradable golf tee according to claim 1, said biodegradable golf tee further comprising an exterior surface wherein said exterior surface is applied with a corn starch adhesive protecting said rendered animal meal from ambient humidity.

5. A biodegradable golf tee formed from a moldable composition compressible at room temperature and decomposable upon contact with water, comprising a rendered animal meal made from pulverized animal parts selected from the animal group consisting of Bovidae, Suidae, Superclass Agnathia, Superclass Gnathostomdta and Phasianidae, said rendered animal meal being derived from waste products from animal processing and comprises, prior to rendering, by volume:

a. seventy percent (70%) to ninety percent (90%) bone and cartilage;

b. ten percent (10%) to thirty percent (30%) muscle and soft tissues; and c. zero percent (0%) to ten percent (10%) organs.

6. The biodegradable golf tee according to claim 5 wherein said rendered animal meal is molded into the shape of a typical golf tee by applying a pressure onto said rendered animal meal into a dry feed mold, said pressure being at range between 1,700 and 1,900 pounds per square inch.

7. The biodegradable golf tee according to claim 6, said biodegradable golf tee further comprising an exterior surface wherein said exterior surface is applied with a corn starch adhesive protecting said rendered animal meal from ambient humidity.

* * * * *